US006756991B2

(12) United States Patent
Koyama

(10) Patent No.: US 6,756,991 B2
(45) Date of Patent: Jun. 29, 2004

(54) IMAGE DISPLAY APPARATUS AND COLOR SIGNAL ADJUSTMENT DEVICE USED THEREIN

(75) Inventor: Fumio Koyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 334 days.

(21) Appl. No.: 10/048,566

(22) PCT Filed: Jun. 11, 2001

(86) PCT No.: PCT/JP01/04901

§ 371 (c)(1),
(2), (4) Date: Feb. 4, 2002

(87) PCT Pub. No.: WO01/97207

PCT Pub. Date: Dec. 20, 2001

(65) Prior Publication Data

US 2002/0105528 A1 Aug. 8, 2002

(30) Foreign Application Priority Data

Jun. 15, 2000 (JP) ..... 2000-179529

(51) Int. Cl.[7] ..... G09G 5/02

(52) U.S. Cl. ..... 345/602; 345/581; 345/582; 345/88; 345/690

(58) Field of Search ..... 345/582–605, 345/88, 690, 581

(56) References Cited

U.S. PATENT DOCUMENTS 4,864,289 A * 9/1989 Nishi et al. ..... 345/473
5,146,328 A * 9/1992 Yamasaki et al. ..... 348/675
5,251,298 A * 10/1993 Nally ..... 345/568
5,265,210 A * 11/1993 Vatti et al. ..... 345/443
5,442,379 A * 8/1995 Bruce et al. ..... 345/589
5,491,496 A * 2/1996 Tomiyasu ..... 345/690
5,900,860 A * 5/1999 Ueda ..... 345/600
6,573,928 B1 * 6/2003 Jones et al. ..... 348/51
6,664,958 B1 * 12/2003 Leather et al. ..... 345/422
6,664,970 B1 * 12/2003 Matsushita ..... 345/581

FOREIGN PATENT DOCUMENTS

| | | |
|---|---|---|
| JP | A 60-128498 | 7/1985 |
| JP | A 3-18823 | 1/1991 |
| JP | A 6-337402 | 12/1994 |
| JP | A 7-56545 | 3/1995 |
| JP | A 10-117300 | 5/1998 |
| JP | A 11-305734 | 11/1999 |

* cited by examiner

*Primary Examiner*—Matthew C. Bella
*Assistant Examiner*—Mike Rahmjoo
(74) *Attorney, Agent, or Firm*—Oliff & Berridge, plc

(57) ABSTRACT

A color signal adjustment module adjusts first through third color signals corresponding to first through third colors expressing a color image. The color signal adjustment device includes: first through fourth RAMs available as lookup tables for adjusting color signal levels; an address selection module that replaceably allocates the first through the third color signals and a predetermined address signal to input address signals of the first through the fourth RAMs, in response to a preset selection signal; and a data selection module that selectively outputs at least three output signals among output signals from the first through the fourth RAMs as first through third output color signals corresponding to the first through the third colors, in response to the preset selection signal.

Such arrangement enables lookup tables to be rewritten without causing superimposition of noise in a displayed image or a variation in color tone of the displayed image.

2 Claims, 10 Drawing Sheets

IMAGE DISPLAY APPARATUS AND COLOR SIGNAL ADJUSTMENT DEVICE USED THEREIN

TECHNICAL FIELD

The present invention relates to a color signal adjustment device that adjusts first through third color signals according to lookup tables and to an image display apparatus using the same.

BACKGROUND ART

An image display apparatus like a projector has a color signal adjustment device for correcting non-linear input-output characteristics (gamma characteristics) of a display device, such as a liquid crystal panel. The color signal adjustment device utilizes lookup tables for correction of the input-output characteristics. Each lookup table represents a mapping of linear tone values of each color signal, red (R), green (G), or blue (B) to non-linear tone values for correction of the gamma characteristics.

FIG. 10 is a block diagram schematically illustrating the structure of a prior art color signal adjustment device. The prior art color signal adjustment device 300 includes three address selector circuits 310R, 310G, and 310B corresponding to respective color signals R, G, and B and three RAMs 320R, 320G, and 320B, as well as one data selector 330. Lookup tables corresponding to the color signals R, G, and B are respectively stored in the three RAMs 320R, 320G, and 320B.

The first address selector 310R selects either an R color signal RI or an address signal AD supplied via an external address bus (not shown) as an input address signal in response to a first address selection signal SLTR and supplies the selected input address signal to the RAM 320R. In a similar manner, the second address selector 310G selects either a G color signal GI or the address signal AD as an input address signal in response to a second address selection signal SLTG and supplies the selected input address signal to the RAM 320G. The third address selector 310B selects either a B color signal BI or the address signal AD as an input address signal in response to a third address selection signal SLTB and supplies the selected input address signal to the RAM 320B.

The data selector 330 selects one of output color signals RO, GO, and BO read from the three RAMs 320R, 320G, and 320B in response to the first through the third address selection signals SLTR, SLTG, and SLTB, and supplies the selected output color signal as reading data RD to an external data bus. Writing data WD is supplied to the three RAMS 320R, 320G, and 320B via an external data bus.

Read-write signals WRR, WRG, and WRB are supplied to control the reading and the writing operations from and into the respective RAMs 320R, 320G, and 320B. In the reading process of the respective RAMs 320R, 320G, and 320B, data corresponding to the input address signals are read and output as the respective output color signals RO, GO, and BO.

During the operation of the image display apparatus, the respective color signals RI, GI, and BI are selected in the first through the third address selectors 310R, 310G, and 310B as the input address signals into the RAMS 320R, 320G, and 320B. Corresponding data are read from the lookup tables stored in the RAMs 320R, 320G, and 320B and are output as the output color signals RO, GO, and BO.

The lookup tables for the respective colors are stored into the RAMs 320R, 320G, and 320B of the corresponding colors according to an exemplified procedure discussed below.

The procedure first stores the lookup table for the color R into the RAM 320R of the color R. The procedure selects the address signal AD supplied via the address bus in the first address selector 310R as the input address signal into the RAM 320R. The procedure then writes the writing data WD supplied via the data bus at the address in the RAM 320R specified by the address signal AD. At this moment, the output of the RAM 320R is generally cut off, and the output color signal RO is fixed to either a high level or a low level by a connected terminal resistance (not shown). Alternatively a variation in data at the address may be output directly.

In the same manner as that for the RAM 320R of the color R, the procedure stores the lookup table for the color G into the RAM 320G of the color G by selecting the address signal AD in the second address selector 310G as the input address signal into the RAM 320G of the color G. Like the RAMs 320R and 320G of the colors R and G, the lookup table for the color B is stored into the RAM 320B of the color B by selecting the address signal AD in the third address selector 310B as the input address signal into the RAM 320B of the color B.

As described above, the lookup tables for the respective colors are sequentially stored into the three RAMs 320R, 320G, and 320B of the corresponding colors.

Storage of the lookup tables for the respective colors into the RAMs 320R, 320G, and 320B of the corresponding colors is generally carried out in the course of initializing the image display apparatus.

In some cases, however, it is required to rewrite and update the lookup tables for the respective colors stored in the RAMs 320R, 320G, and 320B of the corresponding colors during the operation of the image display apparatus. For example, there may be a requirement of rewriting the lookup tables to adjust the contrast, the brightness, and the color tone.

During the operation of the image display apparatus, lookup tables are generally written in a blanking period. The lookup tables stored in the RAMs 320R, 320G, and 320B are sequentially rewritten as mentioned above. It accordingly takes a relatively long time to complete the rewriting operation. The rewriting may thus be performed during the display. The rewriting during the display causes output of specific data intrinsic to the rewriting operation, for example, high-level data or low-level data in the above example. This disadvantageously causes superimposition of noise on the displayed image.

One applicable procedure to prevent superimposition of noise does not use the lookup table for display only in the course of rewriting the lookup table. In this case, however, the displayed image during the rewriting of the lookup table is defined by color signals without gamma correction and adjustment of the contrast or brightness. This disadvantageously changes the color tone of the displayed image.

The object of the present invention is thus to solve the drawbacks of the prior art technique discussed above and to provide a technique that enables lookup tables to be rewritten without causing superimposition of noise in a displayed image or a variation in color tone of the displayed image during operation of an image display apparatus.

DISCLOSURE OF THE INVENTION

At least part of the above and the other related objects is attained by an image display apparatus of the present invention, which includes: a color signal adjustment module that adjusts first through third color signals corresponding to first through third colors expressing a color image; an image display module that displays a color image defined by first through third output color signals from the color signal adjustment module; and an adjustment control module that controls the color signal adjustment module. The color signal adjustment module has: first through fourth RAMs available as lookup tables for adjusting color signal levels; an address selection module that replaceably allocates the first through the third color signals and a predetermined address signal to input address signals of the first through the fourth RAMs, in response to a preset selection signal from the adjustment control module; and a data selection module that selectively outputs at least three output signals among output signals from the first through the fourth RAMs as the first through the third output color signals corresponding to the first through the third colors, in response to the preset selection signal.

During the normal operation, the first through the third lookup tables corresponding to the first through the third color signals are allocated to three RAMs selected among the first through the fourth RAMs, and one RAM is set in the vacant state (namely the RAM is not used for storage of the lookup table). The first through the third lookup tables may be updated according to the following procedure. In one example, it is assumed that the first through the third original lookup tables are stored in the first through the third RAMs and that the fourth RAM is set in the vacant state. The procedure sets the first updated lookup table into the fourth RAM. This causes the first RAM, in which the first original lookup table has been stored, to be set in the vacant state. The procedure then sets the second updated lookup table into the first RAM in the vacant state. This causes the second RAM, in which the second original lookup table has been stored, to be set in the vacant state. The procedure subsequently sets the third updated lookup table into the second RAM in the vacant state.

In this manner, one of the four RAMs is sequentially set in the vacant state. The arrangement of sequentially setting the updated lookup tables into the RAMs in the vacant state ensures the new settings of the lookup tables by utilizing only the RAMs that are not currently involved in adjustment of color signals. This arrangement desirably enables the lookup tables to be rewritten without causing superimposition of noise in a displayed image or a variation in color tone of the displayed image, which is observed in the prior art apparatus during the operation of the image display apparatus.

The present invention is also directed to a color signal adjustment device that adjusts first through third color signals corresponding to first through third colors expressing a color image. The color signal adjustment device includes: first through fourth RAMs available as lookup tables for adjusting color signal levels; an address selection module that replaceably allocates the first through the third color signals and a predetermined address signal to input address signals of the first through the fourth RAMs, in response to a preset selection signal; and a data selection module that selectively outputs at least three output signals among output signals from the first through the fourth RAMs as first through third output color signals corresponding to the first through the third colors and a predetermined output signal, in response to the preset selection signal.

Application of the color signal adjustment device of the present invention to the color signal adjustment module gives the image display apparatus of the present invention.

BEST MODES OF CARRYING OUT THE INVENTION

A. General Construction of Image Display Apparatus

Figure 1:
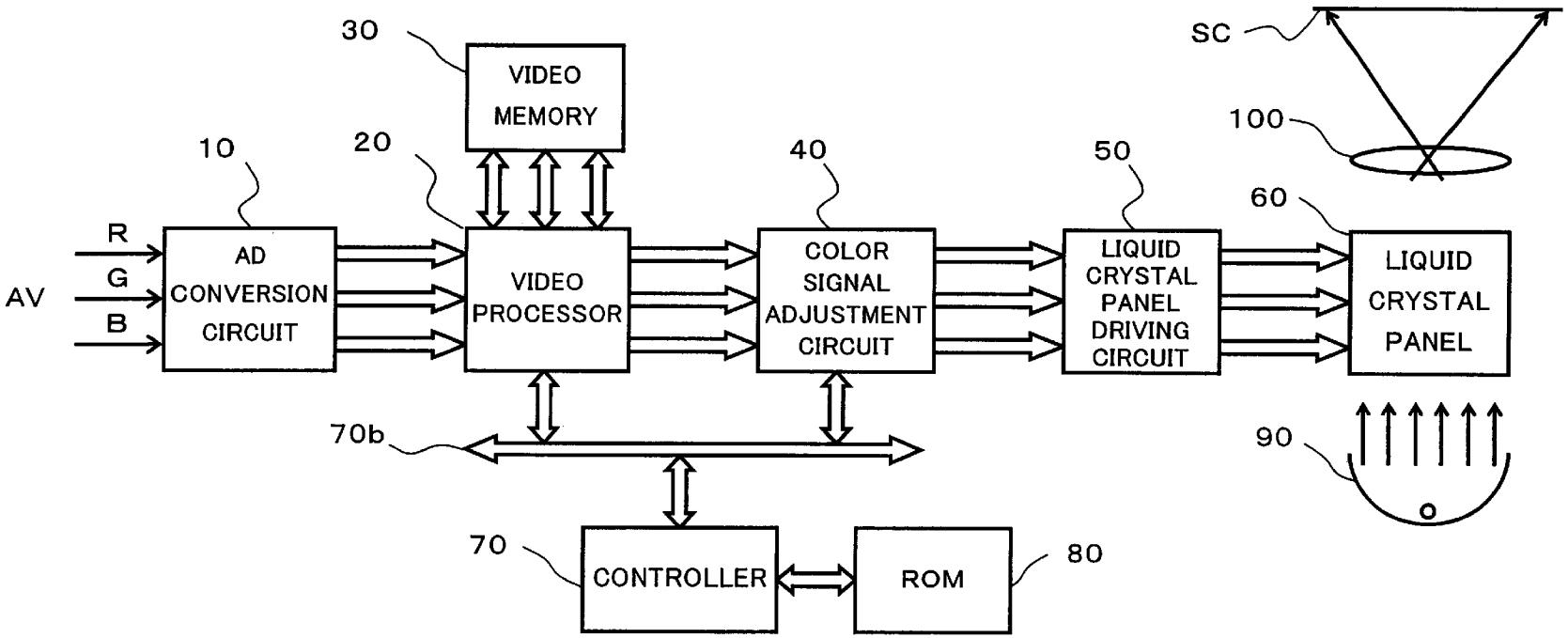
FIG. 1 is a block diagram illustrating the general construction of an image display apparatus in one embodiment of the present invention.

One mode of carrying out the present invention is discussed below as an embodiment. FIG. 1 is a block diagram illustrating the general construction of an image display apparatus in one embodiment of the present invention. This image display apparatus includes an AD conversion circuit 10, a video processor 20, and a video memory 30 functioning as an image processing module, a color signal adjustment circuit 40 functioning as a color signal adjustment module (color signal adjustment device), a liquid crystal panel driving circuit 50 and a liquid crystal panel 60 functioning as an image display module, and a controller 70 and a ROM 80 functioning as an adjustment control module. The video processor and the color signal adjustment circuit 40 are connected to the controller 70 via a bus 70*b*. The controller 70 includes a CPU and controls the operations of the video processor 20 and the color signal adjustment circuit 40 according to data stored in the ROM 80. The controller 70 also performs diverse settings of the video processor 20 and the color signal adjustment circuit 40 according to data stored in the ROM 80. For example, lookup tables for respective colors R, G, and B are stored in the color signal adjustment circuit 40.

This image display apparatus is generally called a projector and has an illumination device 90 that illuminates the liquid crystal panel 60 and a projection optical system 100 that projects light, which is output from the liquid crystal panel 60 to represent a resulting image, onto a screen SC. The liquid crystal panel 60 is used as a light valve (light modulator) that modules light emitted from the illumination device 90.

Although not being specifically illustrated, the liquid crystal panel 60 consists of three liquid crystal panels for R, G, and B. The illumination device 90 has a color light separation optical system that divides white light into three color light rays. The projection optical system 100 has a composition optical system that combines the three color light rays output from the liquid crystal panel 60. The detailed construction of the optical system in such a projector is disclosed, for example, in JAPANESE PATENT LAID-OPEN GAZETTE No. 10-171045 filed by the applicant of the present invention, and is not specifically described here.

One possible modification is a direct-vision image display apparatus that omits the projection optical system 100 and has the liquid crystal panel 60 consisting of only one color liquid crystal panel.

The AD conversion circuit 10 converts respective color signals R, G, and B included in an input analog video signal AV into digital color signals.

The video processor 20 writes the respective digital color signals input from the AD conversion circuit 10 into the video memory 30, while reading the data from the video memory 30 as respective color signals. The video processor 20 carries out diverse image processing like expansion and contraction of images in the writing or reading process.

Lookup tables corresponding to the respective color signals are stored in the color signal adjustment circuit 40. The color signals input from the video processor 20 are converted into processed color signals with gamma correction and adjustment of the contrast and the brightness according to these lookup tables. The color signals output from the color signal adjustment circuit 40 are sent to the liquid crystal panel driving circuit 50. The liquid crystal panel driving circuit 50 generates a driving signal for driving the liquid crystal panel 60 in response to each given color signal. The liquid crystal panel 60 modulates the light emitted from the illumination device 90 in response to the driving signal. The modulated light is projected onto the screen SC via the projection optical system 100. A projected image is accordingly displayed on the screen SC.

B. Internal Structure of Color Signal Adjustment Circuit 40

Figure 2:
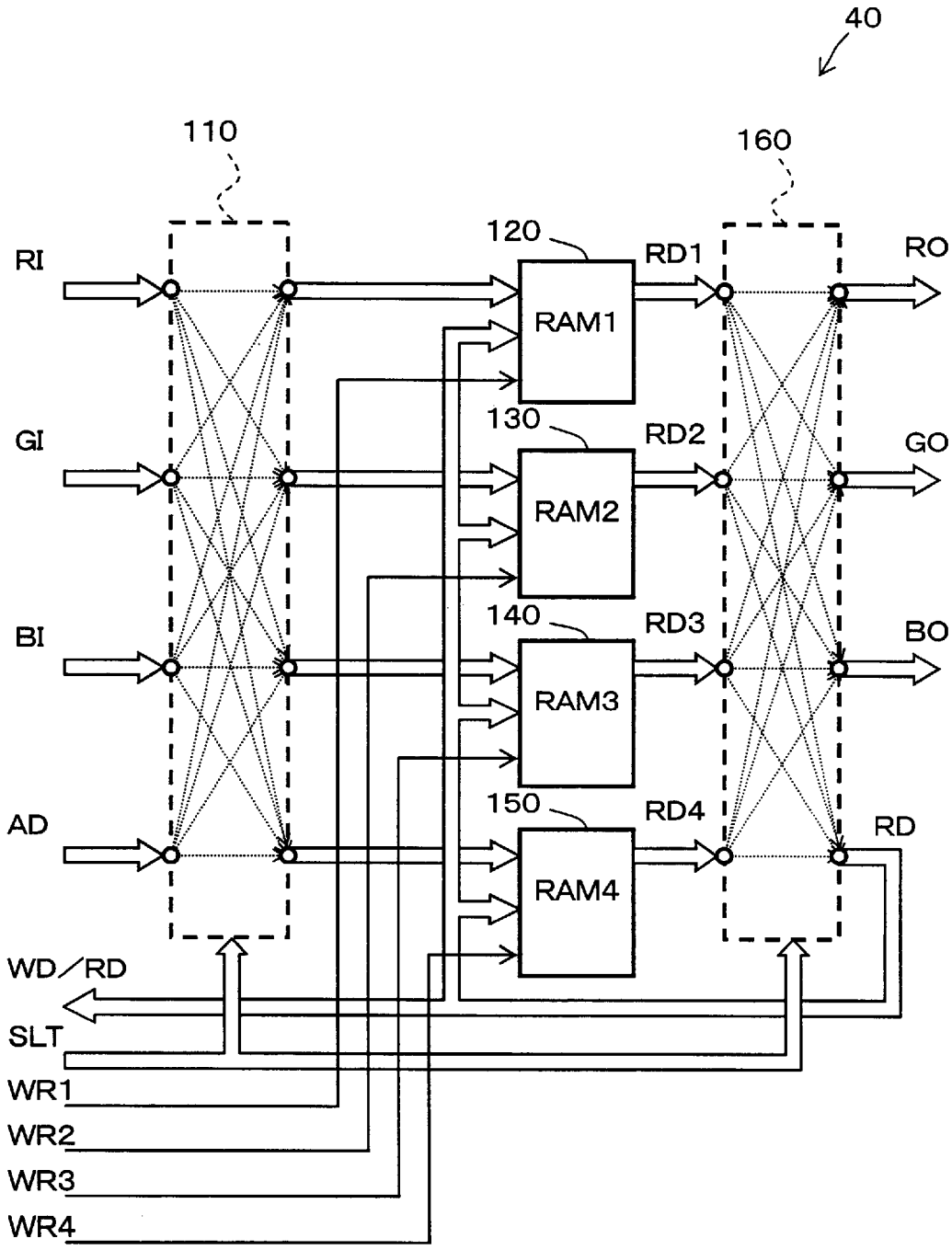
FIG. 2 is a block diagram illustrating the internal structure of a color signal adjustment circuit 40.

FIG. 2 is a block diagram illustrating the internal structure of the color signal adjustment circuit 40. The color signal adjustment circuit 40 includes an address selection circuit 110, four RAMs 120 to 150, and a data selection circuit 160.

The address selection circuit 110 replaceably allocates an R color signal RI, a G color signal GI, a B color signal BI, and an address signal AD supplied via the bus 70*b* to input address signals of the four RAMs 120 to 150, in response to a selection signal SLT. Here it is not allowed to select one signal as input address signals into multiple RAMs. For example, when the R color signal RI is selected as the input address signal into the first RAM 120, it is not allowed to select the R color signal RI as any of the input address signals into the second through the fourth RAMS 130 to 150. It is also not allowed to select multiple signals as the input address signal into one RAM. For example, when the R color signal RI is selected as the input address signal into the first RAM 120, it is not allowed to select any of the G color signal GI, the B color signal BI, and the address signal AD as the input address signal into the fist RAM 120.

The data selection circuit 160 replaceably allocates output signals RD1 to RD4 read from the four RAMs 120 to 150 to output color signals RO, GO, and BO of the respective colors R, G, and B and a reading signal RD, in response to the selection signal SLT. The selection of the data selection circuit 160 is linked with the selection of the color signal in the address selection circuit 110. For example, when the R color signal RI is selected as the input address signal into the first RAM 120, the output signal RD1 of the first RAM 120 is selected as the output color signal RO of the color R and is not selected as any of the output color signals GO and BO of the other colors and the reading signal RD. When the address signal AD is selected as the input address signal into the first RAM 120, the output signal RD1 is selected as the reading signal RD. Such restriction is applied for the other RAMs 130 to 150.

The reading and the writing operations into and from the four RAMs 120 to 150 are independently controlled by read-write signals WR1 to WR4 supplied thereto respectively. For example, when the R color signal RI is selected as the input address signal into the first RAM 120, the reading operation from the first RAM 120 is carried out in response to the read-write signal WR1, and the output signal RD1 is output as the output color signal RO of the color R.

When the address signal AD is selected as the input address signal into the first RAM 120, the reading operation or the writing operation is carried out in response to the read-write signal WR1. In the writing operation, writing data VD supplied from the controller 70 (see FIG. 1) via the data bus of the bus 70*b* is written at an address specified by the address signal AD of the first RAM 120. In the reading operation, data is read from the address specified by the address signal AD and the output signal RD1 is output as the reading signal RD. The reading signal RD is supplied to the controller 70 via the data bus of the bus 70*b*.

In the same manner as that for the first RAM 120, the reading and the writing operations from and into the second through the fourth RAMs 130 to 150 are carried out.

C. Settings of Lookup Tables

C1. Initial Settings

Figure 3:
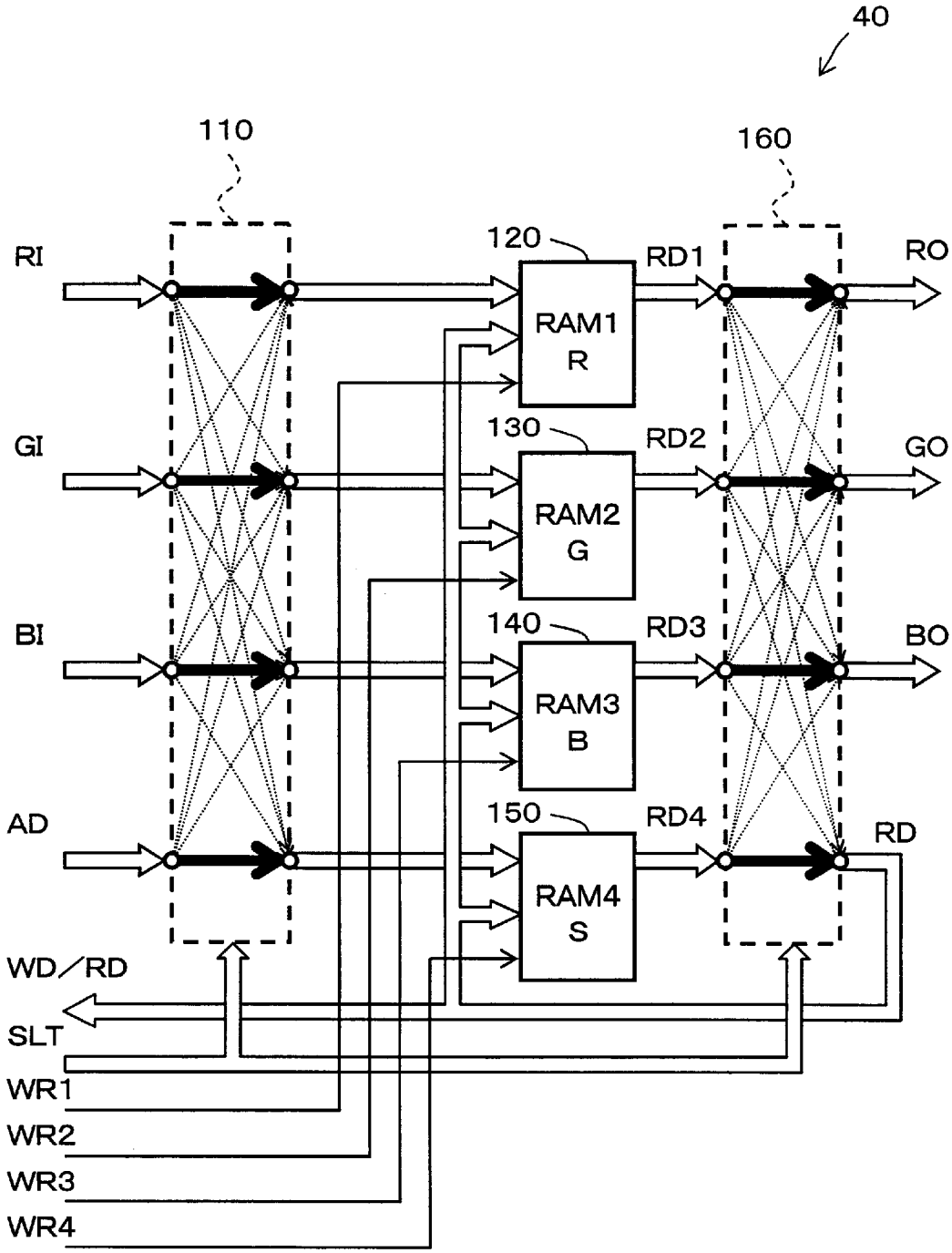
FIG. 3 shows the color signal adjustment circuit 40 in the process of initializing the image display apparatus.

FIG. 3 shows the color signal adjustment circuit 40 in the process of initializing the image display apparatus. In the example of FIG. 3, the lookup tables for R, G, and B are respectively set in the first through the third RAMs 120 to 140. The color signals RI, GI, and BI of the respective colors R, G, and B are selected in the address selection circuit 110 as the input address signals into the first through the third RAMs 120 to 140. The output signals RD1 to RD3 of the first through the third RAMs 120 to 140 are selected in the data selection circuit 160 as the output color signals RO, GO, and BO of the respective colors R, G, and B. In the initial stage, no lookup table is set in the fourth RAM 150. Lookup tables of the respective colors are set in the process of initializing the image display apparatus according to the following procedure.

Figure 4:
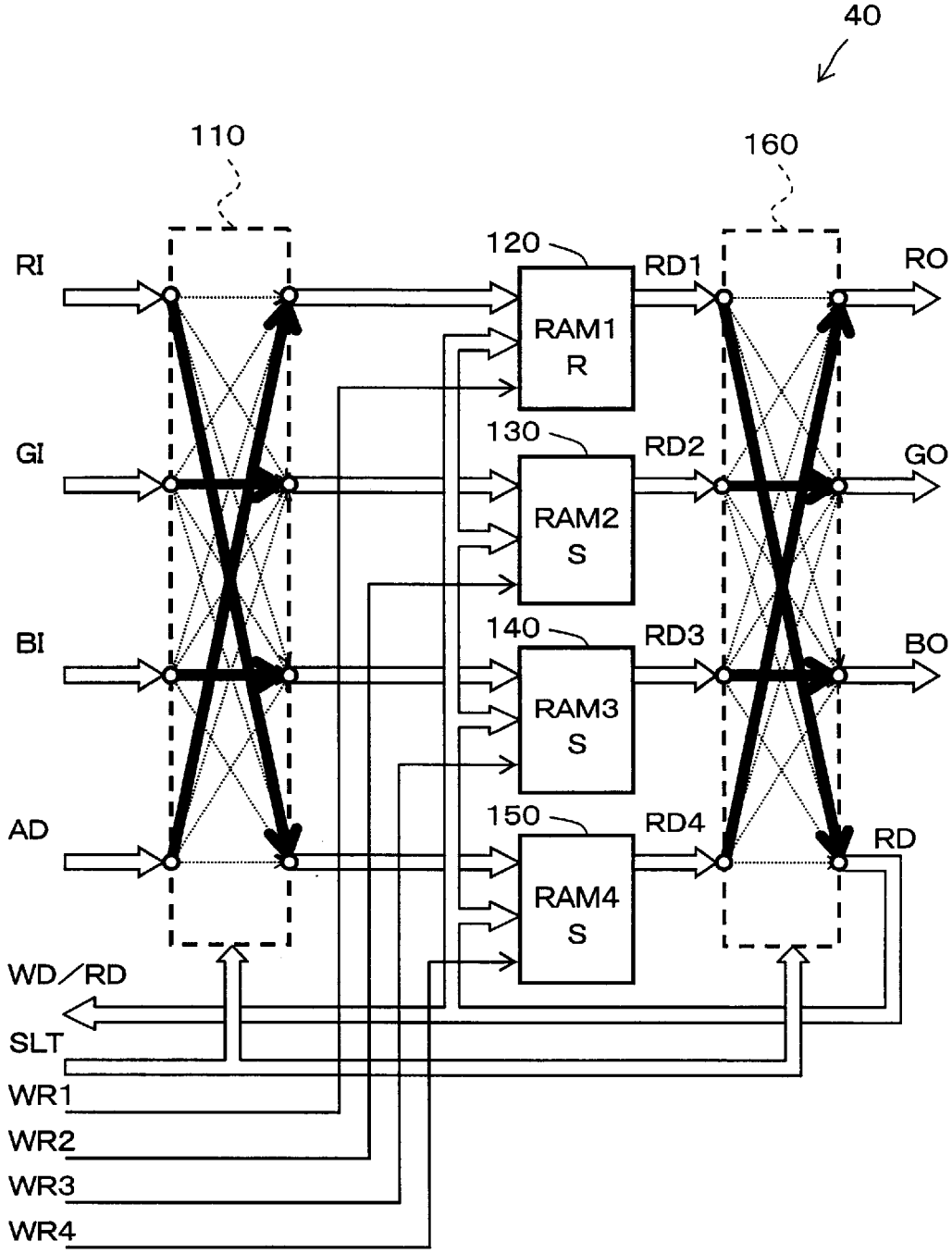
FIG. 4 shows a process of setting a lookup table for a color R into a first RAM 120.

The procedure first sets the lookup table for R in the first RAM 120. FIG. 4 shows a process of setting the lookup table for R into the first RAM 120. The procedure selects the address signal AD in the address selection circuit 110 as the input address signal into the first RAM 120, and subsequently selects the output signal RD1 of the first RAM 120 in the data selection circuit 160 as the reading signal RD. The procedure then writes the writing data WD into the first RAM 120 in response to the address signal AD. This sets the lookup table for R in the first RAM 120. There is no restriction in selection of other signals in the address selection circuit 110 and the data selection circuit 160. In the example of FIG. 4, the R color signal RI is selected as the input address signal of the fourth RAM 150, while the output signal RD4 of the fourth RAM 150 is selected as the output color signal RO of the color R. The G color signal GI is selected as the input address signal of the second RAM 130, while the output signal RD2 of the second RAM 130 is selected as the output color signal GO of the color G. The B color signal BI is selected as the input address signal of the third RAM 140, while the output signal RD3 of the third RAM 140 is selected as the output color signal BO of the color B.

In the case where the writing signal (writing data) WD is written into the first RAM 120 in response to the read-write signal WR1, the output of the first RAM 120 is generally under the condition of a high impedance and is cut off. This prevents interference of the writing signal WD and the output signal RD1. This phenomenon is also found in the second through the fourth RAMs 130 to 150 discussed below.

Figure 5:
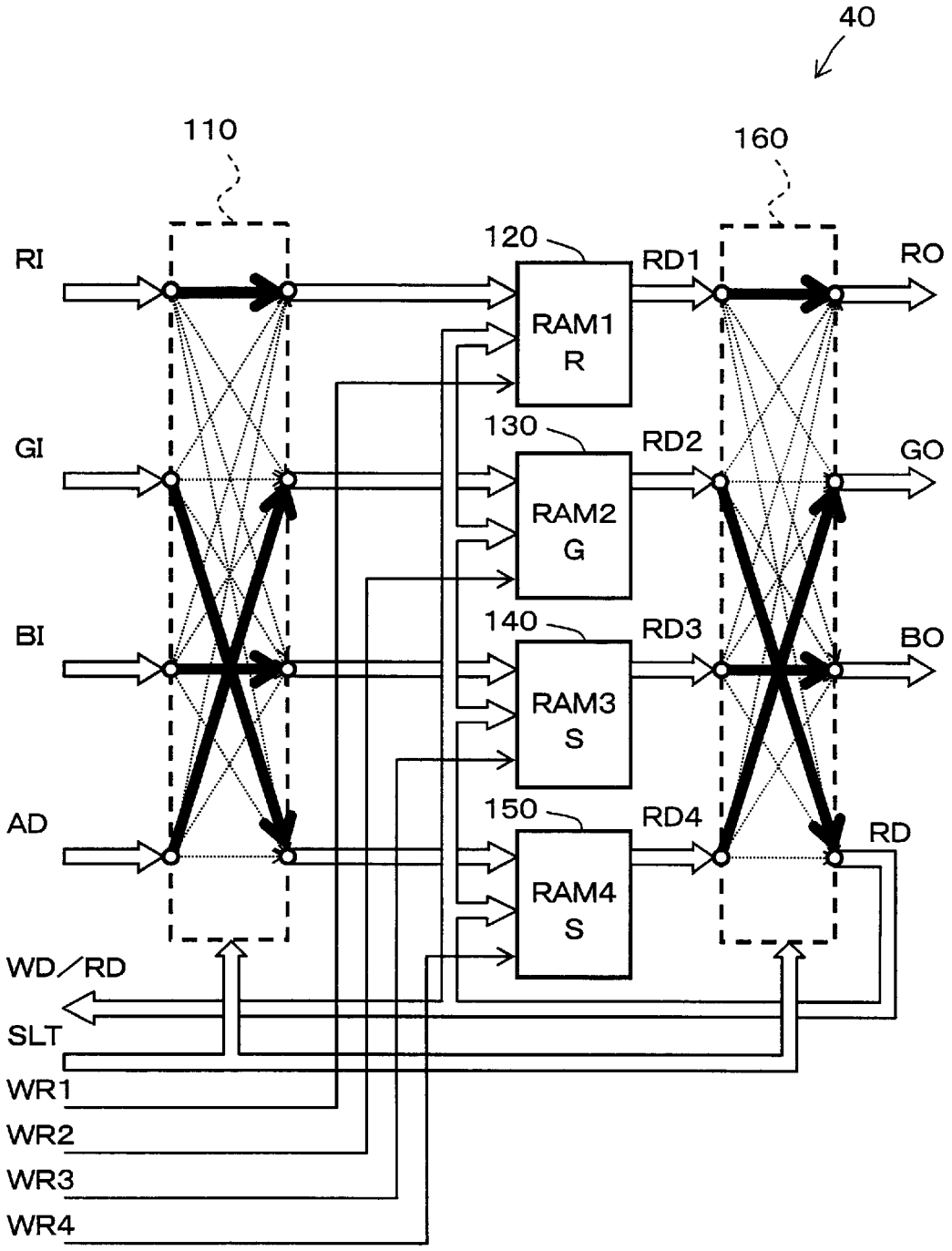
FIG. 5 shows a process of setting a lookup table for a color G into a second RAM 130.

The procedure then sets the lookup table for G in the second RAM 130. FIG. 5 shows a process of setting the lookup table for G into the second RAM 130. The procedure selects the address signal AD in the address selection circuit 110 as the input address signal into the second RAM 130, and subsequently selects the output signal RD2 of the second RAM 130 in the data selection circuit 160 as the reading signal RD. The procedure then writes the writing data WD into the second RAM 130 in response to the address signal AD. This sets the lookup table for G in the second RAM 130. There is no restriction in selection of other signals in the address selection circuit 110 and the data selection circuit 160. In the example of FIG. 5, the lookup table for R has been set in the first RAM 120. The R color signal RI is accordingly selected as the input address signal of the first RAM 120, while the output signal RD1 of the first RAM 120 is selected as the output color signal RO of the color R. The G color signal GI is selected as the input address signal of the fourth RAM 150, while the output signal RD4 of the fourth RAM 150 is selected as the output color signal GO of the color G. The B color signal BI is selected as the input address signal of the third RAM 140, while the output signal RD3 of the third RAM 140 is selected as the output color signal BO of the color B.

Figure 6:
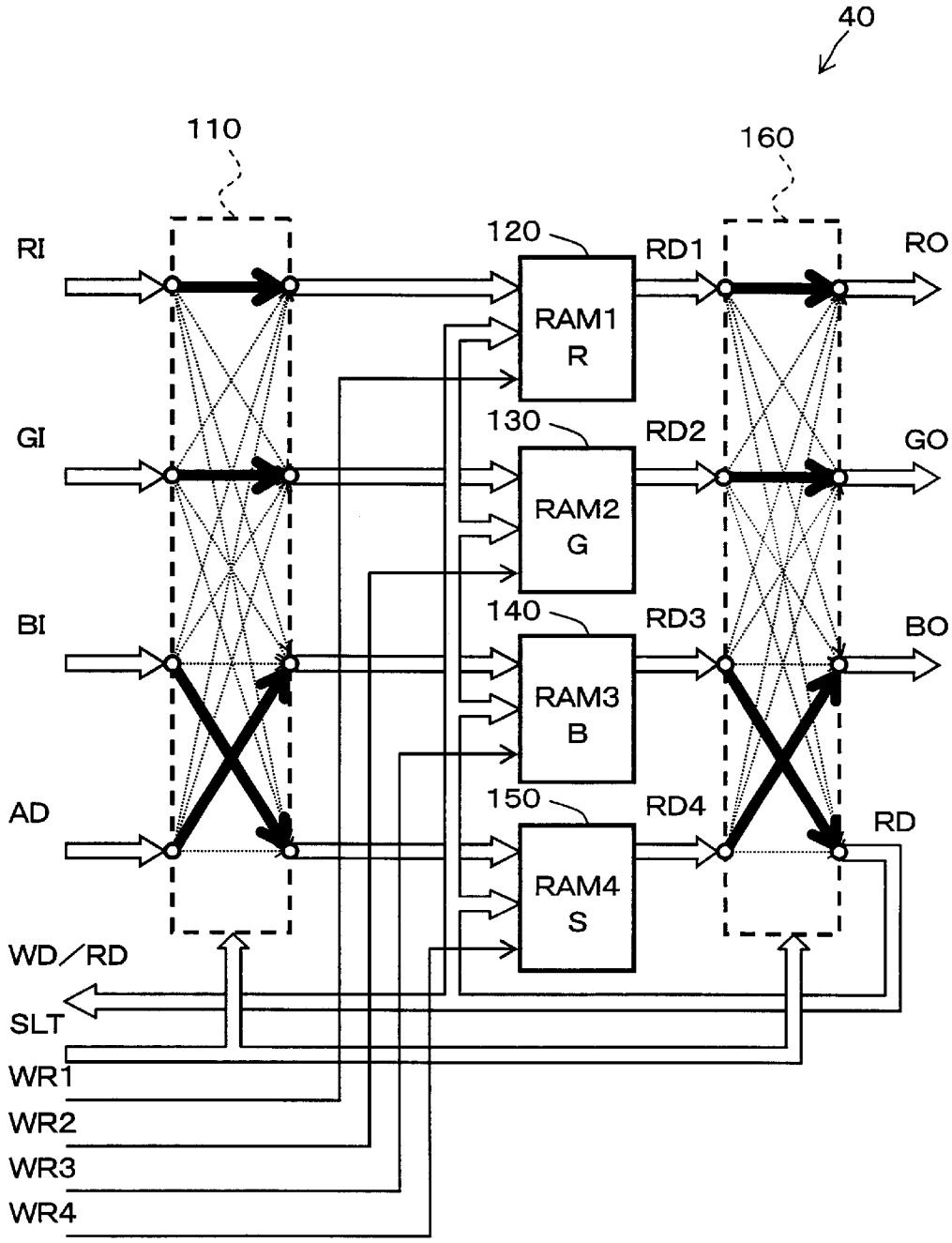
FIG. 6 shows a process of setting a lookup table for a color B into a third RAM 140.

The procedure subsequently sets the lookup table for B in the third RAM 140. FIG. 6 shows a process of setting the lookup table for B into the third RAM 140. The procedure selects the address signal AD in the address selection circuit 110 as the input address signal into the third RAM 140, and subsequently selects the output signal RD3 of the third RAM 140 in the data selection circuit 160 as the reading signal RD. The procedure then writes the writing data WD into the third RAM 140 in response to the address signal AD. This sets the lookup table for B in the third RAM 140. There is no restriction in selection of other signals in the address selection circuit 110 and the data selection circuit 160. In the example of FIG. 6, the lookup table for R has been set in the first RAM 120. The R color signal RI is accordingly selected as the input address signal of the first RAM 120, while the output signal RD1 of the first RAM 120 is selected as the output color signal RO of the color R. The lookup table for G has been set in the second RAM 130. The G color signal GI is accordingly selected as the input address signal of the second RAM 130, while the output signal RD2 of the second RAM 130 is selected as the output color signal GO of the color G. The B color signal BI is selected as the input address signal of the fourth RAM 150, while the output signal RD4 of the fourth RAM 150 is selected as the output color signal BO of the color B.

In the address selection circuit 110 and the data selection circuit 160, the procedure then selects the R color signal RI as the input address signal of the first RAM 120, the output signal RD1 of the first RAM 120 as the output color signal RO of the color R, the G color signal GI as the input address signal of the second RAM 130, the output signal RD2 of the second RAM 130 as the output color signal GO of the color G, the B color signal BI as the input address signal of the third RAM 140, and the output signal RD3 of the third RAM 140 as the output color signal BO of the color B. This completes the setting shown in FIG. 3.

In the above manner, the lookup tables for the respective colors R, G, and B are set in the first through the third RAMs 120 to 140 in the process of initializing the image display apparatus. The fourth RAM 150 is set in the vacant state (the state in which the RAM is not used for storage of the lookup table).

C2. Updating

A series of processing discussed below is adopted to rewrite and update the lookup tables during the operation of the image display apparatus.

The fourth RAM 150 is set in the vacant state in the color signal adjustment circuit 40 of FIG. 3. The updated lookup table for R is accordingly set in the fourth RAM 150 in the vacant state. Setting the lookup table for R into the fourth RAM 150 follows the procedure of setting the lookup table for R into the first RAM 120 discussed previously with FIG. 4, and is thus not specifically described here. The fourth RAM 150, instead of the first RAM 120, is here the target RAM. There is accordingly a requirement of changing the destination of selection in the address selection circuit 110 and in the data selection circuit 160 to the fourth RAM 150.

Figure 7:
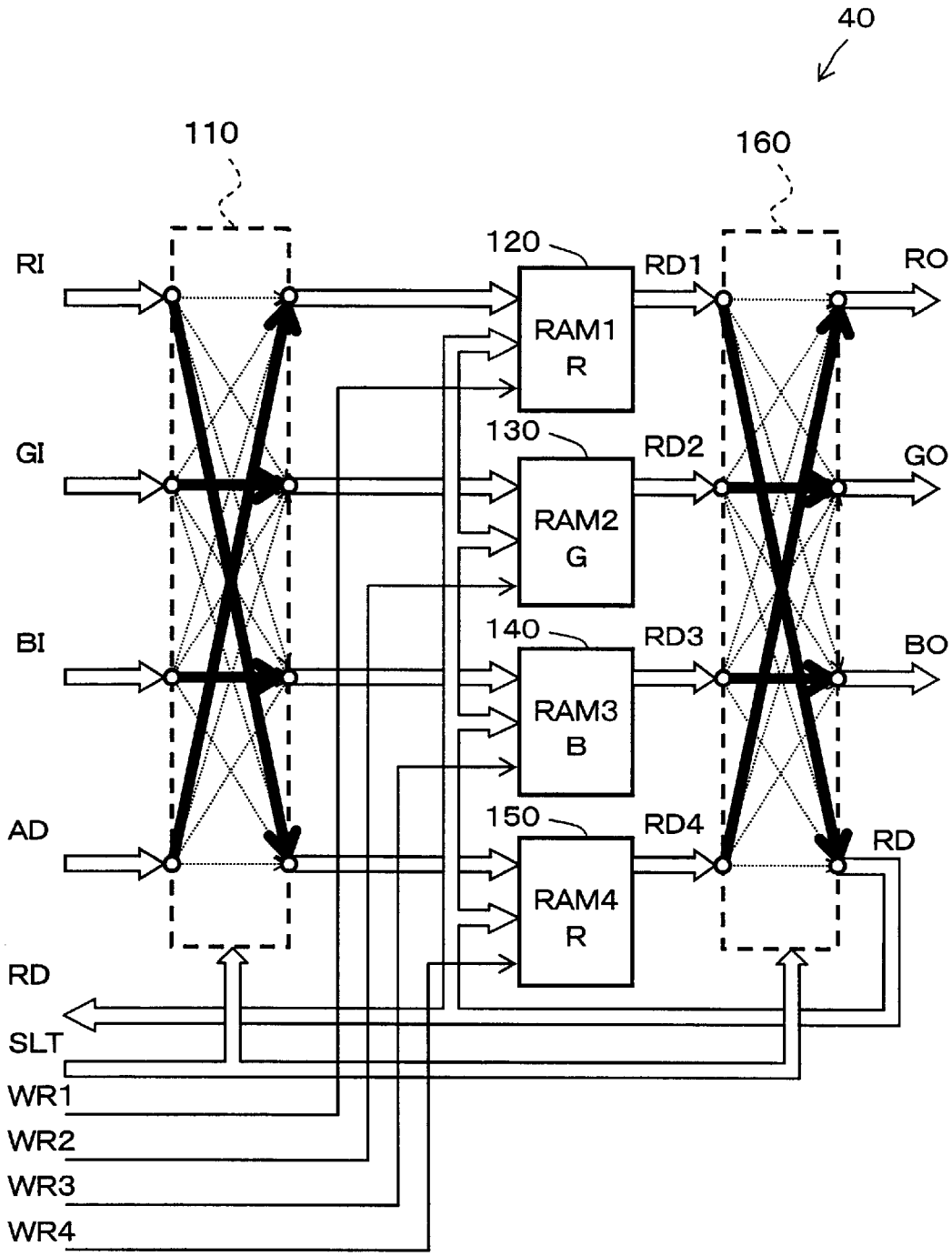
FIG. 7 shows the color signal adjustment circuit 40 after rewriting of the lookup table for R.

FIG. 7 shows the color signal adjustment circuit 40 after rewriting of the lookup table for R. Since the new lookup table for R has been stored in the fourth RAM 150, in the address selection circuit 110, the R color signal RI is selected as the input address signal of the fourth RAM 150 while the address signal AD is selected as the input address signal of the first RAM 120. In the data selection circuit 160, the output signal RD4 of the fourth RAM 150 is selected as the output color signal RO, while the output signal RD1 of the first RAM 120 is selected as the reading signal RD.

At this moment, the original non-rewritten lookup table for R, which is not required, is present in the first RAM 120 of FIG. 7. The updated lookup table for G is accordingly set in the first RAM 120. Setting the lookup table for G into the first RAM 120 follows the procedure of setting the lookup table for G into the second RAM 130 discussed previously with FIG. 5, and is thus not specifically described here; The first RAM 120, instead of the second RAM 130, is here the target RAM. There is accordingly a requirement of changing the destination of selection in the address selection circuit 110 and in the data selection circuit 160 to the first RAM 120.

Figure 8:
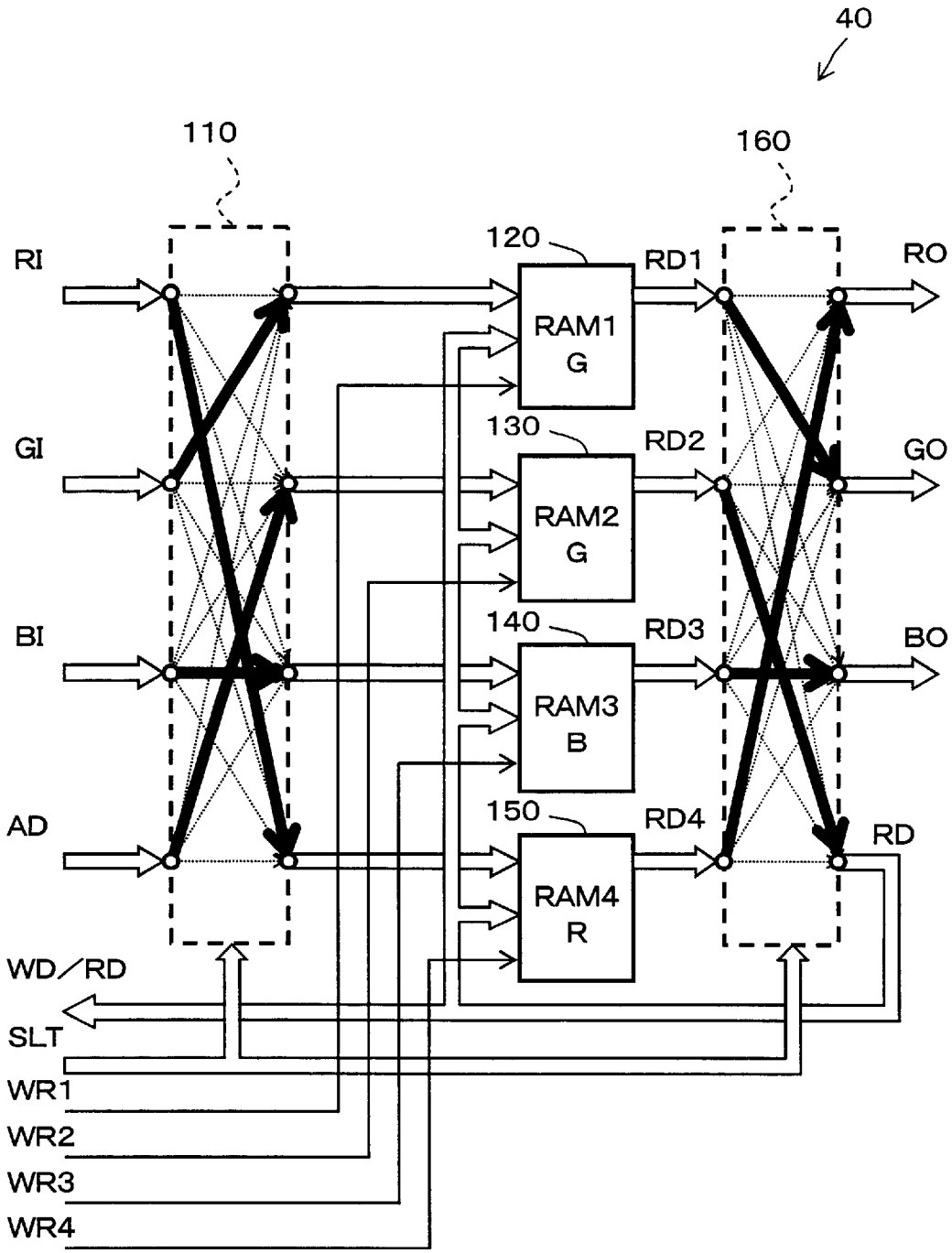
FIG. 8 shows the color signal adjustment circuit 40 after rewriting of the lookup table for G.

FIG. 8 shows the color signal adjustment circuit 40 after rewriting of the lookup table for G. Since the new lookup table for G has been stored in the first RAM 120, in the address selection circuit 110, the G color signal GI is selected as the input address signal of the first RAM 120 while the address signal AD is selected as the input address signal of the second RAM 130. In the data selection circuit 160, the output signal RD1 of the first RAM 120 is selected as the output color signal GO, while the output signal RD2 of the second RAM 130 is selected as the reading signal RD.

At this moment, the original non-rewritten lookup table for G, which is not required, is present in the second RAM 130 of FIG. 8. The updated lookup table for B is accordingly set in the second RAM 130. Setting the lookup table for B into the second RAM 130 follows the procedure of setting the lookup table for B into the third RAM 140 discussed previously with FIG. 6, and is thus not specifically described here. The second RAM 130, instead of the third RAM 140, is here the target RAM. There is accordingly a requirement of changing the destination of selection in the address selection circuit 110 and in the data selection circuit 160 to the second RAM 130.

Figure 9:
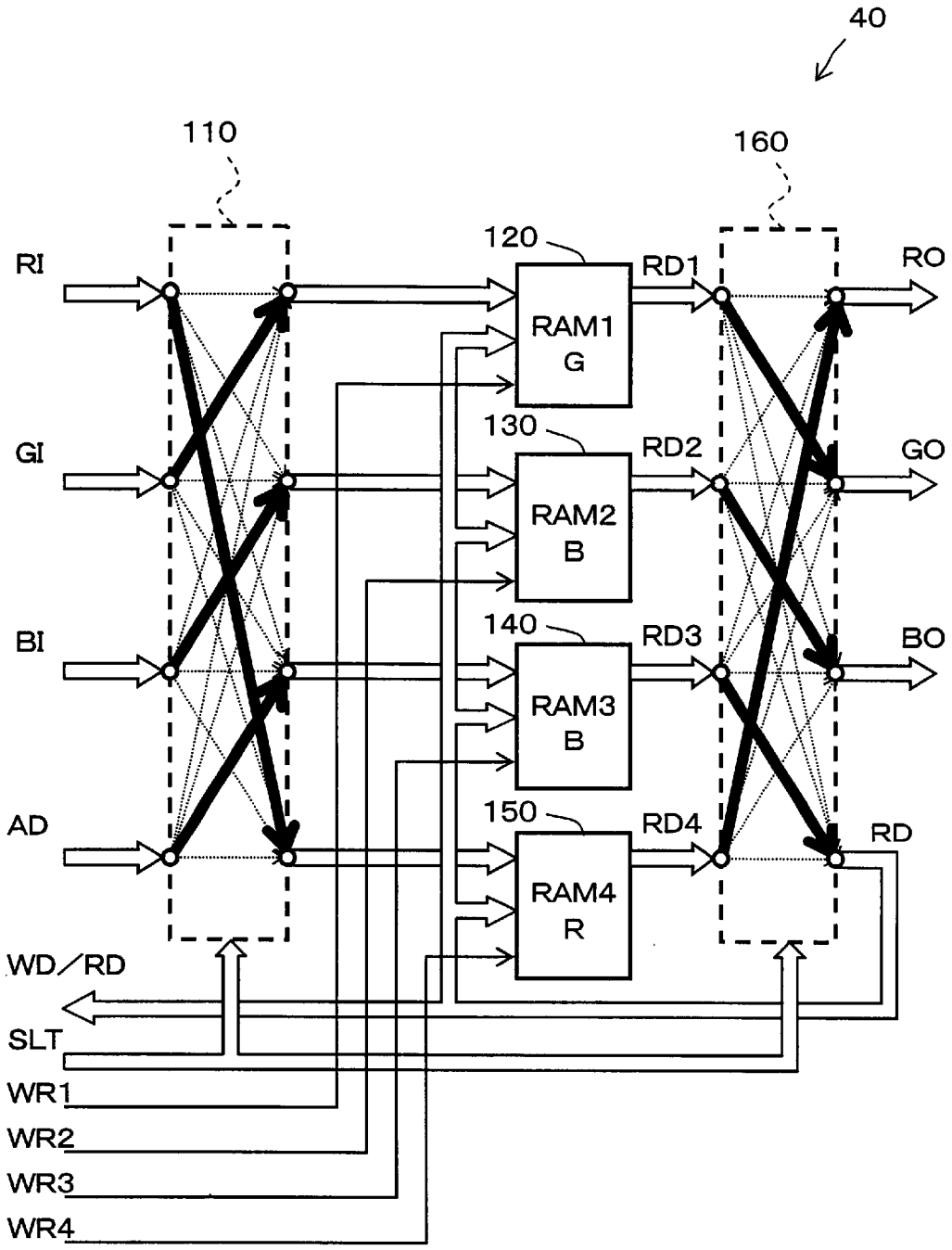
FIG. 9 shows the color signal adjustment circuit 40 after rewriting of the lookup table for B.
Figure 10:
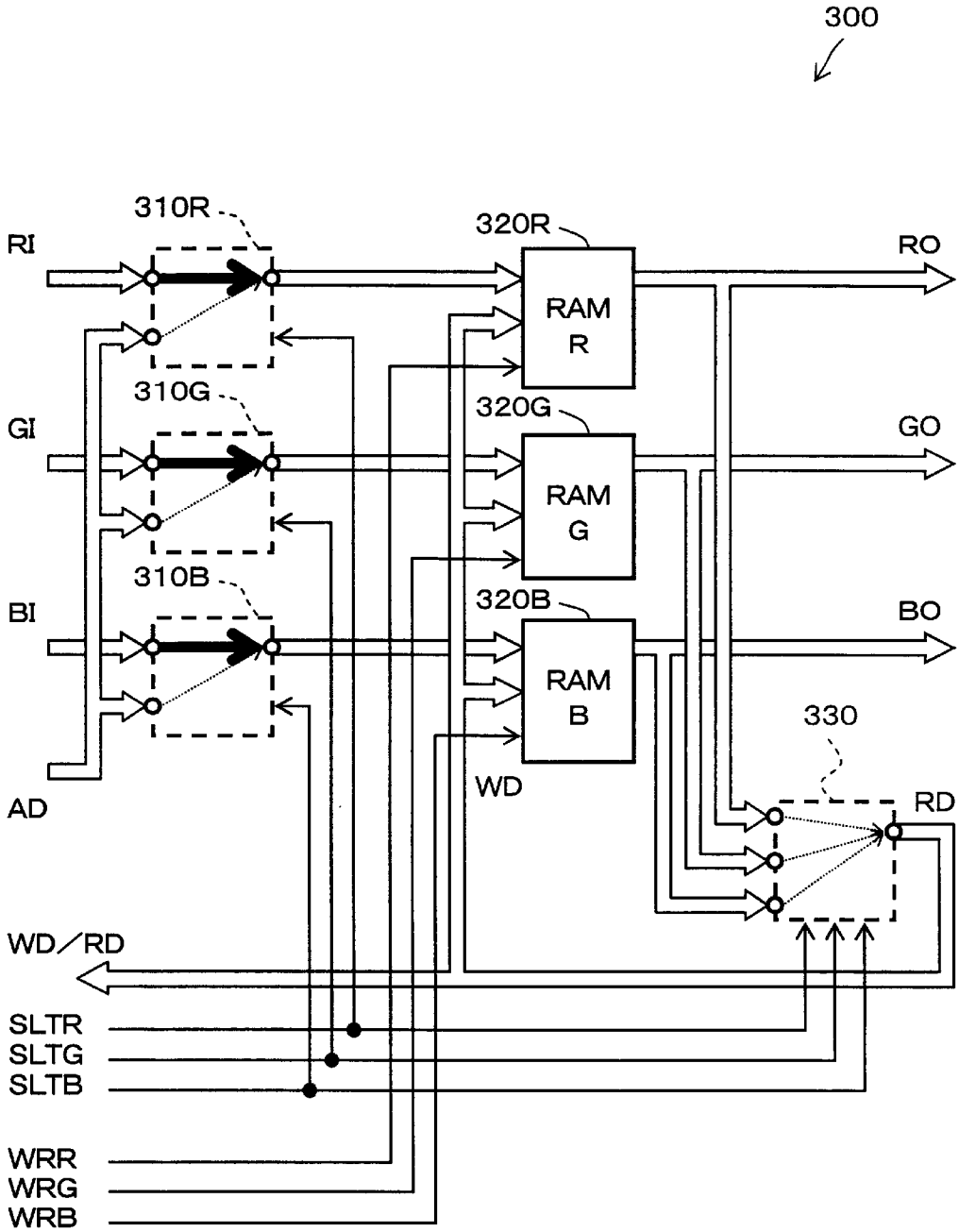
FIG. 10 is a block diagram schematically illustrating the structure of a prior art color signal adjustment device.

FIG. 9 shows the color signal adjustment circuit 40 after rewriting of the lookup table for B. Since the new lookup table for B has been stored in the second RAM 130, in the address selection circuit 110, the B color signal BI is selected as the input address signal of the second RAM 130 while the address signal AD is selected as the input address signal of the third RAM 140. In the data selection circuit 160, the output signal RD2 of the second RAM 130 is selected as the output color signal BO, while the output signal RD3 of the third RAM 140 is selected as the reading signal RD.

The arrangement of setting an updated lookup table of a desired color into one RAM in the vacant state among the four RAMs 120 to 150 successively specifies a non-required RAM. All the lookup tables for the respective colors can be updated by utilizing the non-required RAMs. Utilization of the non-required RAM for rewriting of the lookup table effectively prevents superimposition of noise, which occurs in the course of rewriting in the prior art apparatus. The displayed image is expressed by the color signals via the lookup tables even in the course of rewriting the lookup tables, so that there is no significant change in color tone.

The above procedure of rewriting the lookup tables is on the assumption that the lookup tables of the respective colors R, G, and B have initially been stored in the first through the third RAMs 120 to 140. The procedure is, however, not restricted to such conditions, but is applicable for the state in which the lookup tables of the respective colors R, G, and B have initially been stored in any three RAMs among the four RAMs 120 to 150. The procedure of the above embodiment rewrites all the lookup tables of the respective colors.

But the procedure is not restricted to this case, but is applicable to rewrite any one or two lookup tables.

The present invention is not restricted to the above embodiment or its modifications, but there may be many other modifications, changes, and alterations without departing from the scope or spirit of the main characteristics of the present invention. Some examples of possible modification are given below.

The above embodiment regards the construction of the projector that utilizes the transmission-type liquid crystal panel as the image display module. The technique of the present invention is, however, applicable to projectors of other types. The projectors of other types include those utilizing a reflection-type liquid crystal panel, those utilizing Digital Micromirror Device (trade mark by Texas Instruments Corporation), and those utilizing a CRT. The technique of the present invention is not restricted to the projector but is applicable to diverse image display apparatuses like a direct-vision image display apparatus.

In the above embodiment, the address selection circuit 110 is constructed to allow arbitrary replacement of the combinations of the four inputs and the four outputs. The address selection circuit 110 is required to actualize at least the predetermined combinations shown in FIGS. 3 through 9. This is also true in the data selection circuit 160.

INDUSTRIAL APPLICABILITY

The color signal adjustment device of the present invention is applicable to image display apparatuses like projectors. Such image display apparatuses are applicable for business use, domestic use, and a wide range of other fields.

What is claimed is:

1. An image display apparatus, comprising:

a color signal adjustment module that adjusts first through third color signals corresponding to first through third colors expressing a color image;

an image display module that displays a color image defined by first through third output color signals from the color signal adjustment module; and an adjustment control module that controls the color signal adjustment module, the color signal adjustment module comprising:

first through fourth RAMs available as lookup tables for adjusting color signal levels;

an address selection module that replaceably allocates the first through the third color signals and a predetermined address signal to input address signals of the first through the fourth RAMs, in response to a preset selection signal from the adjustment control module; and a data selection module that selectively outputs at least three output signals among output signals from the first through the fourth RAMs as the first through the third output color signals corresponding to the first through the third colors, in response to the preset selection signal.

2. A color signal adjustment device that adjusts first through third color signals corresponding to first through third colors expressing a color image, the color signal adjustment device comprising:

first through fourth RAMs available as lookup tables for adjusting color signal levels;

an address selection module that replaceably allocates the first through the third color signals and a predetermined address signal to input address signals of the first through the fourth RAMs, in response to a preset selection signal; and a data selection module that selectively outputs at least three output signals among output signals from the first through the fourth RAMs as first through third output color signals corresponding to the first through the third colors and a predetermined output signal, in response to the preset selection signal.

* * * * *